US007912416B2

(12) United States Patent
Mandel et al.

(10) Patent No.: US 7,912,416 B2
(45) Date of Patent: Mar. 22, 2011

(54) PRINTING SYSTEM ARCHITECTURE WITH CENTER CROSS-OVER AND INTERPOSER BY-PASS PATH

(75) Inventors: Barry Paul Mandel, Fairport, NY (US); Steven Robert Moore, Rochester, NY (US); Injae Choi, Webster, NY (US); Stan Alan Spencer, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 476 days.

(21) Appl. No.: 11/312,081

(22) Filed: Dec. 20, 2005

(65) Prior Publication Data

US 2007/0140767 A1 Jun. 21, 2007

(51) Int. Cl.
*G03G 15/00* (2006.01)

(52) U.S. Cl. ..... 399/381; 399/110; 399/124; 399/388; 399/405; 271/3.19; 271/9.04; 271/264; 271/289; 271/301; 271/302

(58) Field of Classification Search ..... 399/381, 399/110, 124, 388, 405; 271/3.19, 9.04, 271/264, 289, 301, 302
See application file for complete search history.

(56) References Cited

U.S. PATENT DOCUMENTS 4,579,446 A 4/1986 Fujino et al.
4,587,532 A 5/1986 Asano
4,836,119 A 6/1989 Siraco et al.
5,004,222 A 4/1991 Dobashi
5,080,340 A 1/1992 Hacknauer et al.
5,095,342 A 3/1992 Farrell et al.
5,150,167 A * 9/1992 Gonda et al. ..... 399/16
5,159,395 A 10/1992 Farrell et al.
5,208,640 A * 5/1993 Horie et al. ..... 399/110
5,272,511 A 12/1993 Conrad et al.
5,326,093 A 7/1994 Sollitt
5,435,544 A 7/1995 Mandel
5,473,419 A 12/1995 Russel et al.
5,489,969 A 2/1996 Soler et al.
5,504,568 A 4/1996 Saraswat et al.
5,525,031 A 6/1996 Fox
5,557,367 A 9/1996 Yang et al.
5,568,246 A 10/1996 Keller et al.
5,570,172 A 10/1996 Acquaviva
(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner* — Judy Nguyen
*Assistant Examiner* — Andy L Pham
(74) *Attorney, Agent, or Firm* — Fay Sharpe LLP

(57) ABSTRACT

A printing system comprises a paper path architecture for parallel printing using multiple marking engines. The media path configuration enables all the media feed trays to be located in one place, relative to the marking engines. A cross-over module is located between marking engines. The cross-over module can interleave media sheets that are being transported away from a first marking engine with the sheets being transported to the second marking engine. The cross-over module also includes a straight through path that enables media sheets to be transported directly to a finishing device without going through either marking engine. The marking engines include internal duplex loops such that media can be supplied to each engine in alternate groups. A merge module selectively merges the media which can then be further processed in a finishing transition module prior to communication to a finishing device.

12 Claims, 5 Drawing Sheets

U.S. PATENT DOCUMENTS

| | | | | |
|---|---|---|---|---|
| 5,596,416 | A | 1/1997 | Barry et al. | |
| 5,629,762 | A | 5/1997 | Mahoney et al. | |
| 5,710,968 | A | 1/1998 | Clark et al. | |
| 5,778,377 | A | 7/1998 | Marlin et al. | |
| 5,884,910 | A | 3/1999 | Mandel | |
| 5,995,721 | A | 11/1999 | Rourke et al. | |
| 6,059,284 | A | 5/2000 | Wolf et al. | |
| 6,125,248 | A | 9/2000 | Moser | |
| 6,241,242 | B1 | 6/2001 | Munro | |
| 6,297,886 | B1 | 10/2001 | Cornell | |
| 6,341,773 | B1 | 1/2002 | Aprato et al. | |
| 6,384,918 | B1 | 5/2002 | Hubble, III et al. | |
| 6,450,711 | B1 | 9/2002 | Conrow | |
| 6,476,376 | B1 | 11/2002 | Biegelsen et al. | |
| 6,476,923 | B1 | 11/2002 | Cornell | |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,819,906 | B1 | 11/2004 | Herrmann et al. | |
| 6,925,283 | B1 | 8/2005 | Mandel et al. | |
| 6,959,165 | B2 | 10/2005 | Mandel et al. | |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |
| 2006/0039727 | A1 * | 2/2006 | Lofthus et al. | 399/381 |

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/235,979, filed Sep. 27, 2005, Anderson et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/236,099, filed Sep. 27, 2005, Anderson et al.

* cited by examiner

PRINTING SYSTEM ARCHITECTURE WITH CENTER CROSS-OVER AND INTERPOSER BY-PASS PATH

BACKGROUND

The present exemplary embodiments relate to media (e.g., documents, paper or the like) handling systems and systems for printing thereon and is especially applicable for printing systems comprising a plurality of associated image output terminals ("IOTs").

The subject application is related to the following co-pending applications: U.S. Ser. No. 10/924,113, for "Printing System with Inverter Disposed For Media Velocity Buffering and Registration";

U.S. Ser. No. 10/924,459, for "Parallel Printing Architecture Consisting of Containerized Image Marking Engine Modules";

U.S. Ser. No. 10/924,458, for "Print Sequence Scheduling for Reliability"; and

U.S. Ser. No. 10/924,106, for "Printing System with Horizontal Highway and Single Pass Duplex".

Printing systems including a plurality of IOTs are known and are generally referred to as tandem engine printers. See U.S. Pat. No. 5,568,246. Such systems facilitate expeditious duplex printing (both sides of a document are printed) with the first side of a document being printed by one of the IOTs and the other side of the document being printed by another so that parallel printing of sequential documents can occur. The document receives a single pass through the first IOT or marking engine, is inverted and then a single pass through the second IOT for printing on the second side, so effectively the document receives a single pass through the system but is duplex printed. Single pass duplex printing using two printers can be twice as fast as duplex printing in a single IOT. Such tandem printing systems may simply consist of a feed source capable of delivering sheets to the first IOT, the first IOT, a transport communicating sheets from the first to the second IOT, the second IOT, and a finishing module. It should be appreciated that the described printing system offers no advantage over a single IOT for simplex printing productivity.

One approach for constructing tandem printing systems having increased simplex productivity is to provide each IOT with a separate and dedicated feed source for the paper or print media being processed. Consequently, for a two IOT system, this means that operators must access two different places to load media, and then those feed trays will only deliver media directly to their respective marking engine. From an operability standpoint, having all the media located in a single place would be an advantageous feature, at least for the operator. In addition, with separate and dedicated feed sources it is difficult to provide a media path allowing all the media to be delivered to any marking engine, or to selected output devices. Although some known parallel printing systems provide variable route media paths, there is a need for a printing system which can provide essentially a single media feed source to a plurality of marking engines while also providing a variable route media path so media sheets can be directed from the single source to any marking engine or a by-pass path, within the overall system.

Especially for multi-engine, parallel printing systems, architectural innovations which effectively provide maximum media path variability can enhance document process path reliability and increase system efficiency.

SUMMARY

According to aspects illustrated herein, there is provided a printing system comprising a paper path architecture for parallel printing using multiple marking engines. The media path configuration enables all the media feed trays or sources to be located in one general location, relative to the marking engines. A simple media path to and from each marking engine, and a by-pass path enables the feeder modules to be used as an interposer, i.e., without requiring the media within the interposing feeder module to pass through a marking engine. Also, a cross-over module is located between marking engines. Additionally, the cross-over module can interleave printed media sheets that are being transported away from a first marking engine with the blank sheets being transported to the second marking engine. The cross-over module also includes a straight through path that enables media sheets to be transported directly to a finishing device without going through either marking engine. A merge module selectively merges media which can then be further processed in a finishing transition module prior to communication to a finishing device.

In accordance with other aspects illustrated herein, a printing system is provided comprising a media path architecture for facilitating selectively variable printing in a printing system including a plurality of marking engines. The architecture comprises a selectively variable route media path through the printing system, the path having a start and an end. The marking engines each include an internal simplex path and an internal duplex path. Since the marking engines each include an internal duplex path, the system can print duplex jobs by delivering sheets to each marking engine in groups. For example, if each marking engine can handle six letter size sheets in its internal duplex loop, the system can deliver six sheets to the first marking engine and then six sheets to the second marking engine, and then repeat that process. This simplifies the overall delivery and merging of the sheets to and from the marking engines. A diverter module is disposed adjacent the start of the paper path for receiving sheets from the media supply source and for selectively directing the sheets to the variable route paper path. A substantially horizontal media path spans the top of the plurality of marking engines for selective by-passing of the marking engines. A cross-over module is disposed between two of the marking engines and includes a first transport path for receiving media from a first marking engine and transporting the media to the horizontal media path, and a second transport path for receiving media from the horizontal media path and transporting the media to a second marking engine. A finishing device finishes the processing of the sheets and may be associated with a merge module for selective merging of the sheets and a parallel finishing transition module for selective orientation of the sheets.

DETAILED DESCRIPTION OF THE EXEMPLARY EMBODIMENTS

Figure 1:
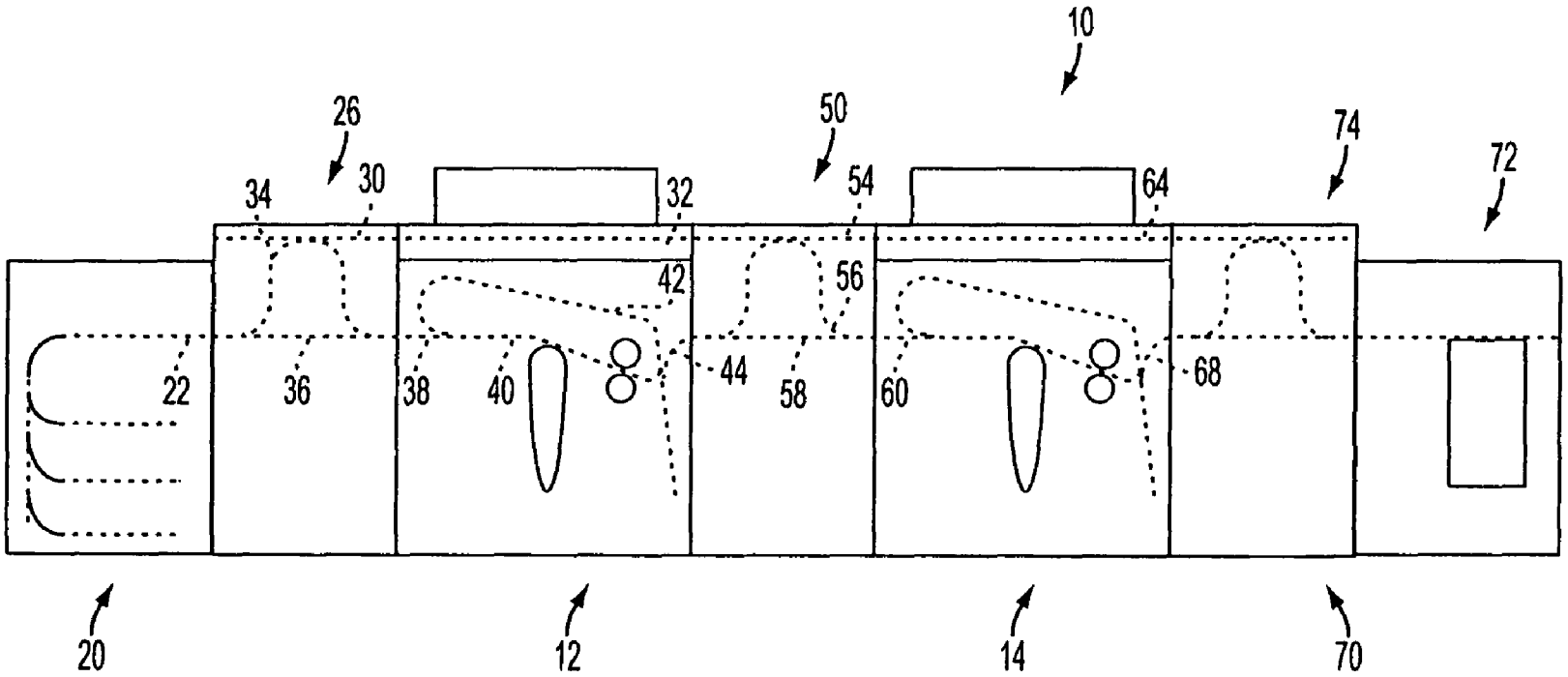
FIG. 1 is a schematic view of a printing system illustrating selective architectural embodiments of the subject development.

With reference to the drawings, the showings are for purposes of illustrating alternative embodiments and not for limiting same. FIG. 1 shows a schematic view of a printing system 10 comprising a plurality of marking engines, IOTs, printers or the like associated for tightly integrated parallel printing of documents within the system. More particularly, the printing system includes a media path architecture for facilitating selectively variable parallel printing via the variable route media path through the printing system. It is a feature of the subject embodiment that a media supply source 20 is exclusively disposed, relative to the marking engines 12, 14 at the start of the media path generally designated at 22 so that the media, printed sheets or the like, can be supplied to either marking engine 12, 14 or by-pass the engines and be communicated directly to the finisher, as will be explained more in detail below. Alternatively, the supply source could be located at another singular point in the system which could supply sheets to all the IOTs of the system. The feeder module 20 is conventional and includes a plurality of feed trays for supplying sheets which are first received in either an entrance diverter module 26 which functions to communicate the sheets to the first marking engine 12 or to a by-pass path for bypassing the marking engine. The diverter module 26 is shown to include three distinct paths comprising an upper by-pass path 30 in direct communication with a first marking engine by-pass path 32, a diverter module cross-over path 34, and a lower by-pass path 36 which can directly transport sheets from the start 22 of the path directly to the entrance 38 of the first marking engine 12 for intended marking of the sheets in the engine. It can be seen that the cross-over path 34 facilitates sheet transport from the start 22 to the upper by-pass path 30, or may communicate such sheets back from the path 30 to the lower by-pass path 36 and the marking engine entrance 38. Both marking engines 12, 14 include an internal simplex path 40 and a duplex path 42 which are conventional in architecture and operation.

Sheets exit the first marking engine 12 from either the first marking engine by-pass path 32 or from marking path exit 44 and are communicated to cross-over module 50. Cross-over module 50 may be essentially common in structural assembly with entrance module 26 to include an upper by-pass path 54, a cross-over path 56 and a lower by-pass path 58. An operational advantage of the cross-over module 50 is that it facilitates interleaving of sheets from sheets communicated from the first marking engine 12 with other sheets destined for the second marking engine 14. More particularly, blank sheets may be transported to the second marking engine 14 over the top of the first marking engine via horizontal by-pass path 32. The timing and disposition of the sheets for the interleaving process is controlled to maximize throughput efficiencies so that a marked sheet from the first marking engine 12 is disposed within the cross-over module to allow the blank sheet to be directed to the entrance path 60 of the second marking engine so it can be marked therein before the sheet already marked by the first engine is communicated to the entrance path 60. Alternatively, sheets marked by the first engine 12 can be transported through the cross-over module for communication over the top of the second marking engine via the second marking engine by-pass path 64. The cross-over module 50 facilitates a variety of selectively available media paths. The sheets may be directly communicated from the feeder module 22 to the second marking engine horizontal by-pass path 64 without having to go through the first marking engine entrance 38 or the cross-over path 56 of cross-over module 50. Alternatively, marked sheets from the first marking engine 12 exiting via path 44 can be directly communicated along path 58 to the entrance 60 of the second marking engine, as where a single pass duplex mode through the system 10 is being employed.

Sheets exit the second marking engine 14 via bypass path 64 or engine exit path 68. The end of the media path is generally designated 70 and comprises a finishing device 72 associated with a finishing merge module 74 which similarly facilitates sheets communication to the device 72 from either by-pass path 64 or marking engine exit 68 and may include structural and operational commonness with modules 26 and 50.

The subject printing system 10 provides significant operational advantages for tightly integrated parallel printing and throughput efficiency. More particularly, a duplex mode printing operation could be effected in the first marking engine 12 wherein duplex printing is effected along a duplex path 42 and then the marked output comprising a plurality of sheets, could be merged together via cross-over module 50 with the second group of sheets. In other words, a group of sheets could be delivered to the first marking engine 12, and then a second group of sheets could be delivered to the second marking engine 14, alternating back and forth. Each marking engine executes a duplex mode printing for the group of sheets in a conventional manner. The group of sheets could then be interleaved via cross-over modules 50 or 74. The result is a job stream having no interruptions while really running parallel jobs within sequentially operating marking engines. In other words, a group of sheets comprising a job portion can be marked in a duplex mode within a single marking engine, another group of sheets can be marked within the second marking engine, but both groups can then be merged, one group after the other, to achieve the desired job stream result.

Figure 2:
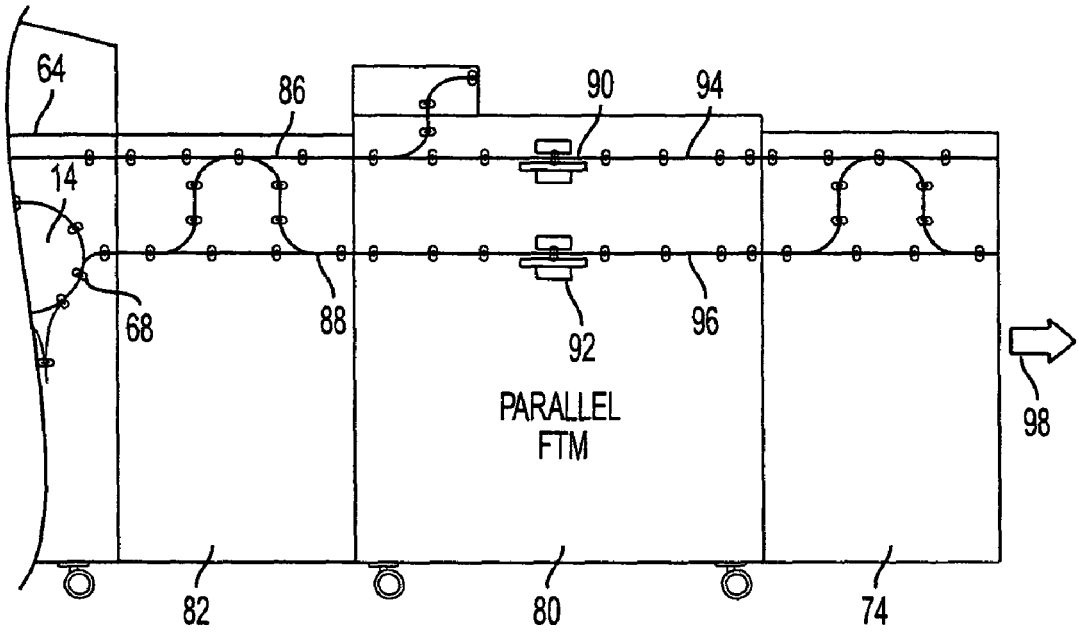
FIG. 2 is a schematic view of an alternative end portion of the printing system.

With particular reference to FIG. 2, an alternative end of the media path is illustrated in which a parallel sheet re-orientation module ("SRM") 80 is included between the second marking engine 14 and the finishing device merge module 74. An interface module 82 receives sheets from a second marking engine by-pass 64 or engine output path 68 and transports the sheets to the SRM 80. SRM 80 executes optional registration, translation and rotation of the sheets so that if the sheets need to be especially oriented for a particular result, i.e., a booklet maker or the like, such orientation can be achieved. It should be noted that the SRM 80 receives sheets from the interface module along two path transports 86, 88 so SRM processing can occur in parallel via SRM processing devices 90, 92 along paths 94, 96 respectively. Upon completion of the SRM processing, the sheets can be interleaved, or merged in module 74 before final transport to the finishing device 72, generally indicated by arrow 98.

Figure 3A:
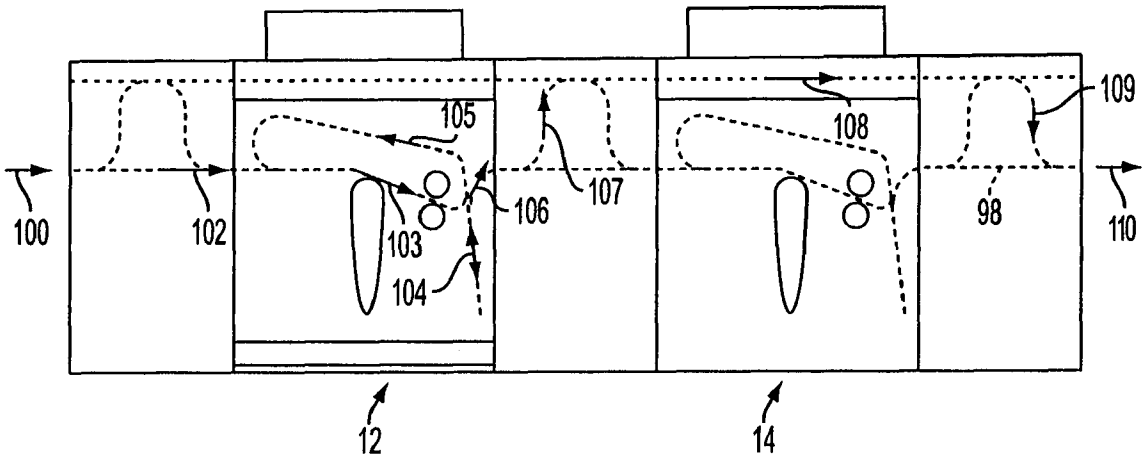
FIGS. 3*a* and 3*b* compriseshowings of an exemplary system duplex operation.
Figure 3B:
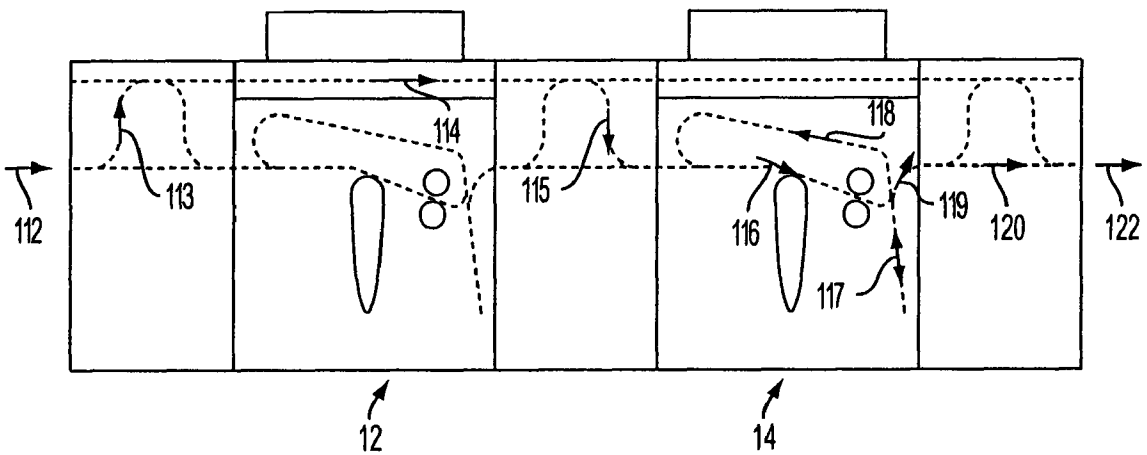
Figure 4:
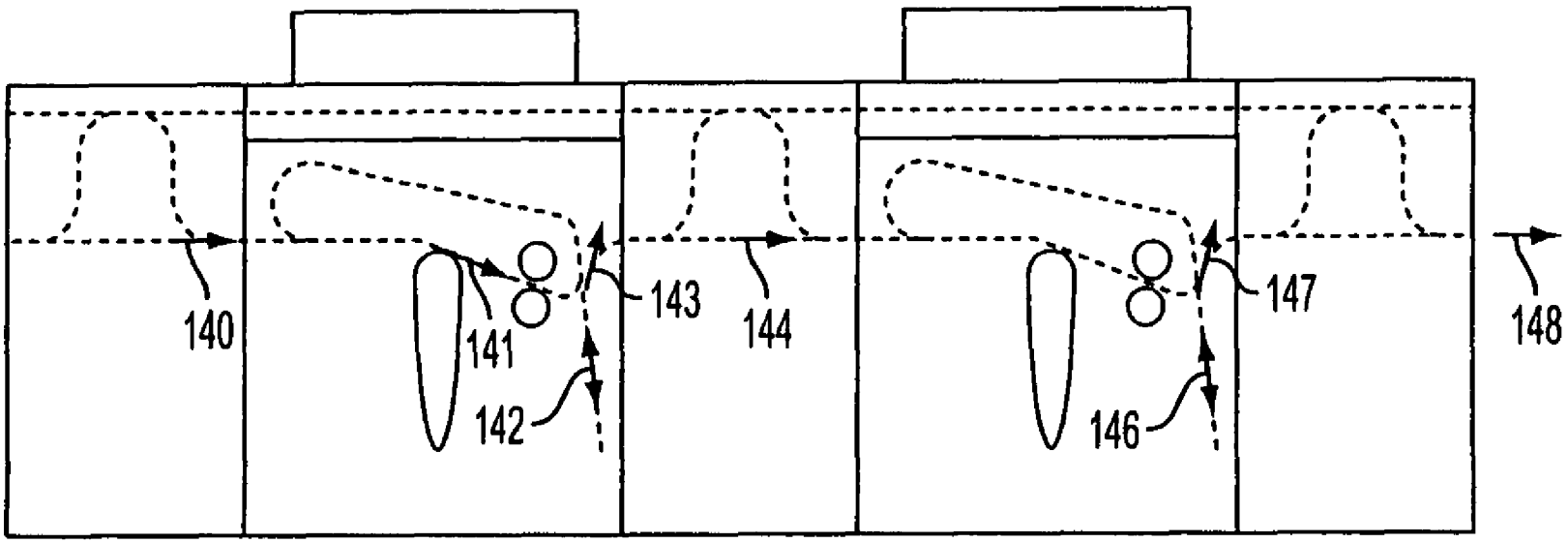
FIG. 4 is a showing of an exemplary system duplex operation in an alternate mode from that of FIGS. 3*a* and 3*b*.

With reference to FIGS. 3, 4 and 5, exemplary system operations can be better appreciated in accordance with the present embodiments. With particular reference to FIGS. 3*a* and 3*b*, exemplary system duplex operation is respectfully illustrated with respect to printing in the first IOT 12 and the second IOT 14. The individual arrows represent sheet processing steps within the operation method. Sheets enter 100 from the media feeder (not shown) and are diverted 102 to the first IOT 12. Side one is printed 103. The printed sheet is then inverted 104, and then recirculated 105 along the internal duplex path and side two is printed. The sheet then exits 106 the first IOT and is diverted 107 to the second IOT bypass path 64 (FIG. 1) where it bypasses 108 the second IOT 14. This sheet is diverted 109 to lower path 98 and then is exited 110 to the finisher module 72 (FIG. 1).

While a first group of media sheets are being printed in the first IOT in this manner, the group can be sized in number to fit within the internal duplex path of the first IOT to comprise a first portion of a job as a first collective group of sheets of the job.

With reference to FIG. 3*b*, the second IOT 14 process steps are shown, which steps can be executed in at least a partial overlap with the processing steps illustrated in FIG. 3*a*.

Again, a sequential collection of sheets enter 112 from the feeder supply source 20 and are diverted 113 in cross-over module 26 to the first IOT bypass path for bypassing 114 the first IOT 12. These sheets are then diverted 115 to the second IOT 14 where a side one of a sheet can be printed 116. The sheet is then inverted 117 and is recirculated so that the second side of the sheet can be printed. The sheet then exits 119 the second IOT and is routed 120 to the lower path 98 so that it can be exited 122 to the finisher.

Again, it is envisioned that the duplex operation in the second IOT comprises a group of sheets being sequentially processed within the internal duplex group path of the second IOT 14. The groups of sheets can then be bundled or interleaved either within the cross-over module 74, or within the finisher as may be desired.

With reference to FIG. 4, an alternative mode of an exemplary system duplex operation is shown. The sheets enter the first IOT from the interface module and pass through 141 the first IOT for side one marking before being inverted 142. The sheets then exit 143 and are routed 144 through the cross-over module to the entrance of the second IOT so that the sheets may pass through 145 the second IOT for side two marking thereof along the internal simplex path therein. The sheet is again inverted 146 before it exits 147 and is then routed 148 to a finisher.

In accordance with this embodiment it can be seen that sheets are sequentially processed through the printing system for duplex printing thereon.

Figure 5A:
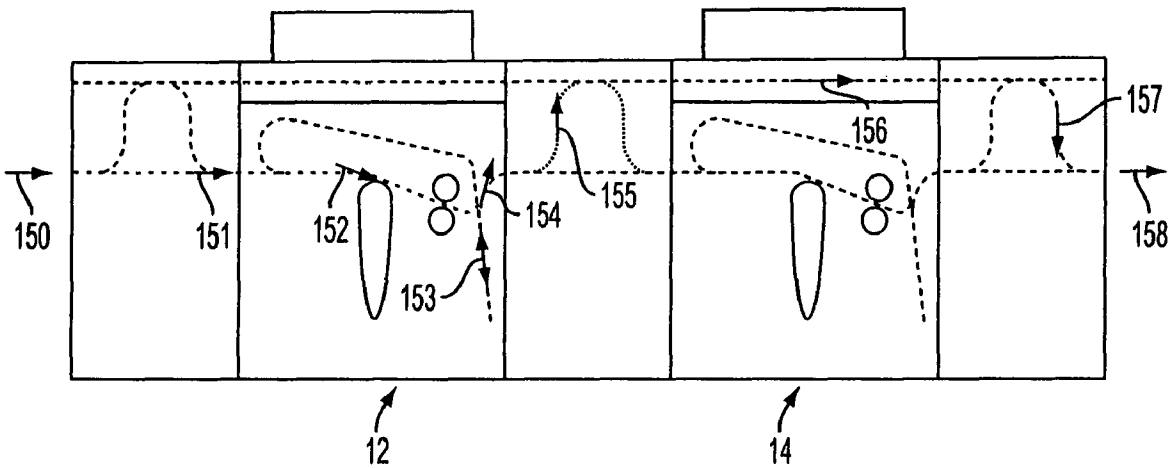
FIGS. 5*a* and 5*b* are showings of an exemplary system simplex operation.
Figure 5B:
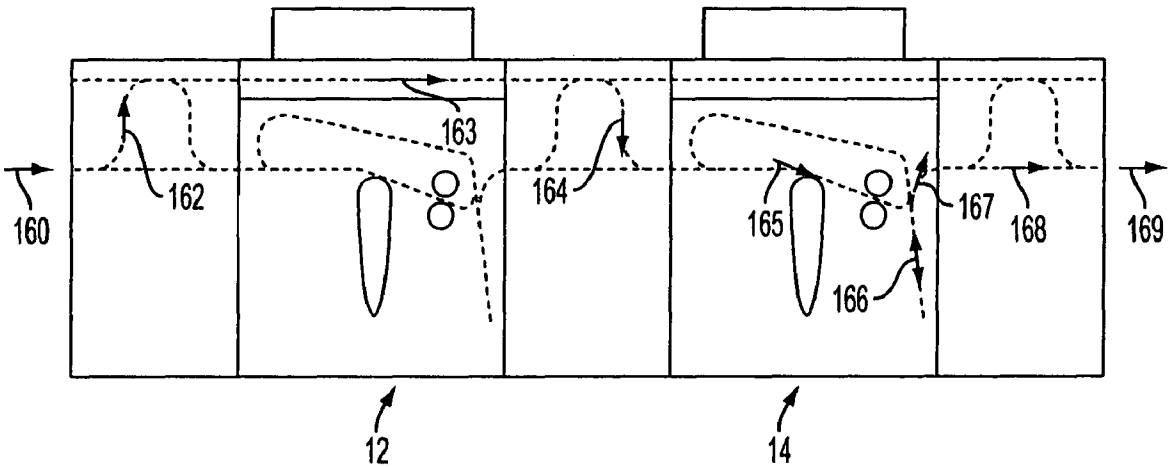

With reference to FIGS. 5*a* and 5*b*, an exemplary system simplex operation is shown. With respect to the first IOT printing steps, sheets enter 150 from the feeder and are diverted 151 to the first IOT 12. Side one of a sheet is printed 152 and then inverted 153 in the first IOT (for face-down output). The sheet then exits 154 the first IOT and is diverted 155 to the second IOT bypass where it bypasses 156 the second IOT 14. The sheet is then diverted 157 to the lower path 98 where it then exits 158 to a finisher.

The second IOT printing processing steps are shown in FIG. 5*b* where, again, sheets enter 160, are then diverted 162 to the first IOT bypass for bypassing 163 the first IOT. The sheets are then diverted 164 to the second IOT for 14 where side one of the sheet is printed 165. The sheet is then inverted 166 in the second IOT (for face-down output) and then are exited 167 to the second IOT. The sheet is then routed 168 on the lower path and exited 169 to a finisher.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The claims can encompass embodiments in hardware, software, or combination thereof.

The phrase "marking engine" as used herein encompasses any apparatus, such as a printer, digital copier, bookmaking machine, facsimile machine, multi-function machine, etc. which performs a printing/outputting function for any purpose using Xerographic, ink-jet or any other marking means. The claims encompass embodiments that print in monochrome or in color or handle color image data.

The invention claimed is:

1. A printing system comprising:

a selective variable route media path through the printing system, the path having a start and an end;

a plurality of image marking engines disposed in the variable route media path, each engine comprising both an internal simplex path and a duplex path;

one and only one media supply source at the start of the media path, wherein said plurality of image marking engines use said media supply source as their media supply source;

a diverter module disposed adjacent the start of the paper path for receiving sheets from said media supply source and for selectively directing the sheets to the variable route paper path;

a media path spanning said plurality of marking engines that is completely separated from the internal simplex path and the duplex path in each engine for selective bypassing of the marking engines;

a cross-over module disposed between two of said image marking engines, said cross-over module including a first transport path for receiving media from a first marking engine and transporting the media to said spanning media path, and a second transport path for receiving media from said spanning media path and transporting the media to a second marking engine; and, a finishing device for finish processing of the sheets including a merge module for selective merging of the sheets;

wherein said cross-over module includes a by-pass transport path for transporting sheets from said media supply source directly to the finishing device without passing through any of said image marking engines.

2. The system of claim 1 wherein said cross-over module includes a by-pass transport path for transporting sheets from the first engine directly to the second engine.

3. The system of claim 1 comprising at least two image marking engines.

4. The system of claim 1 wherein the system comprises means for effecting a plurality of operating modes, including, a first mode in which sheets are alternately fed to each of the plurality of image marking engines, the sheets are printed using the simplex path, and then the sheets are merged together;

a second mode in which sheets are alternately supplied in respective groups to the plurality of marking engines, printed on both sides of the sheets using the internal duplex path of each marking engine, and then the sheets are merged together; and, a third mode in which sheets are printed using at least one of the simplex and duplex paths in one of the marking engines while another of the marking engines is not being used.

5. The system of claim 1 in which said diverter module, cross-over module and merge module comprise a common assembly.

6. The system of claim 1 further including parallel sheet registration transports for accepting media in two or more path locations and performing media registration on more than one sheet at a time.

7. The system of claim 6 further including a transport path to merge outputs after passing through said parallel sheet registration transports.

8. The system of claim 6 in which said parallel sheet registration transports includes means for performing optional sheet rotation.

9. A media path architecture for facilitating selectively variable parallel printing in a printing system including a plurality of marking engines, comprising:

one and only one singularly located media feed source relative to the marking engines including a plurality of feed trays, wherein said plurality of image marking engines use said singularly located media feed source as their media feed source;

a media path spanning said plurality of marking engines that is completely separated from each engine for selective bypassing of the marking engines, wherein said media path comprises a first by-pass media path by-passing a first marking engine and a second by-pass media path by-passing a second marking engine;

a diverter module adjacent the feed source for diverting media from the source to either the first marking engine or the first by-pass media path by-passing the first marking engine;

a cross-over module interposed between the first marking engine and the second marking engine and including a selectively variable media path aligned with both the first by-pass media path and a first output for marked media marked by the first marking engine, and wherein the selectively variable media path includes an interleaving path for interleaving the marked media from the first marking engine with media from the first by-pass media path destined for marking in the second marking engine; and a finishing module for finish processing of the media;

wherein the cross-over module includes a first cross-over module by-pass path for communicating media from the first marking engine directly to the second marking engine.

10. The architecture as defined in claim 9 wherein the interleaving path includes means for alternatively interleaving the marked media from the first marking engine with media from the first by-pass media path destined for the second by-pass media path.

11. A printing system comprising:

a selective variable route media path through the printing system, the path having a start and an end;

a plurality of image marking engines disposed in the variable route media path, each engine comprising both an internal simplex path and a duplex path;

a media supply source exclusively disposed at the start of the media path;

a diverter module disposed adjacent the start of the paper path for receiving sheets from said media supply source and for selectively directing the sheets to the variable route paper path;

a media path spanning said plurality of marking engines that is completely separated from the internal simplex path and the duplex path in each engine for selective bypassing of the marking engines;

a cross-over module disposed between two of said image marking engines, said cross-over module including a first transport path for receiving media from a first marking engine and transporting the media to said spanning media path, and a second transport path for receiving media from said spanning media path and transporting the media to a second marking engine; and a finishing device for finish processing of the sheets including a merge module for selective merging of the sheets.

12. A media path architecture for facilitating selectively variable parallel printing in a printing system including a plurality of marking engines, comprising:

a singularly located media feed source relative to the marking engines including a plurality of feed trays;

a media path spanning said plurality of marking engines that is completely separated from each engine for selective bypassing of the marking engines, wherein said media path comprises a first by-pass media path by-passing a first marking engine and a second by-pass media path by-passing a second marking engine;

a diverter module adjacent the feed source for diverting media from the source to either the first marking engine or the first by-pass media path by-passing the first marking engine;

a cross-over module interposed between the first marking engine and a second marking engine and including a selectively variable media path aligned with both the first by-pass media path and a first output for marked media marked by the first marking engine, and wherein the selectively variable media path includes an interleaving path for interleaving the marked media from the first marking engine with media from the first by-pass media path destined for marking in the second marking engine; and a finishing module for finish processing of the media.

* * * * *